US007934998B2

(12) United States Patent
Yokota

(10) Patent No.: US 7,934,998 B2
(45) Date of Patent: May 3, 2011

(54) GOLF CLUB HEAD

(75) Inventor: Masatoshi Yokota, Kobe (JP)

(73) Assignee: SRI Sports Limited, Kobe (JP)

( * ) Notice: Subject to any disclaimer, the term of this patent is extended or adjusted under 35 U.S.C. 154(b) by 168 days.

(21) Appl. No.: 11/984,949

(22) Filed: Nov. 26, 2007

(65) Prior Publication Data

US 2008/0182681 A1 Jul. 31, 2008

(30) Foreign Application Priority Data

Jan. 26, 2007 (JP) ..... 2007-016694

(51) Int. Cl.
*A63B 53/04* (2006.01)

(52) U.S. Cl. ..... 473/227; 473/332; 473/345

(58) Field of Classification Search ..... 473/324–350
See application file for complete search history.

(56) References Cited

U.S. PATENT DOCUMENTS

| | | | | | |
|---|---|---|---|---|---|
| 1,541,126 | A | * | 6/1925 | Dunn | 473/328 |
| 3,625,518 | A | * | 12/1971 | Solheim | 473/330 |
| 3,976,299 | A | * | 8/1976 | Lawrence et al. | 473/327 |
| 4,444,392 | A | * | 4/1984 | Duclos | 473/290 |
| 5,203,565 | A | * | 4/1993 | Murray et al. | 473/242 |
| 5,288,079 | A | * | 2/1994 | Katayama | 473/328 |
| 5,301,945 | A | * | 4/1994 | Schmidt et al. | 473/311 |
| 5,326,105 | A | * | 7/1994 | Fenton, Jr. | 473/328 |
| 5,435,558 | A | * | 7/1995 | Iriarte | 473/327 |
| 5,451,056 | A | * | 9/1995 | Manning | 473/328 |
| 5,460,376 | A | * | 10/1995 | Schmidt et al. | 473/328 |
| 5,467,988 | A | * | 11/1995 | Henwood | 473/345 |
| 5,470,068 | A | * | 11/1995 | Schmidt et al. | 473/311 |
| 5,470,069 | A | * | 11/1995 | Schmidt et al. | 473/311 |
| 5,630,766 | A | * | 5/1997 | Granelli | 473/313 |
| 5,697,853 | A | * | 12/1997 | Schmidt et al. | 473/328 |
| 6,120,389 | A | * | 9/2000 | Kruse | 473/328 |
| 6,332,848 | B1 | * | 12/2001 | Long et al. | 473/328 |
| 6,645,087 | B2 | | 11/2003 | Yabu | |
| 6,960,141 | B2 | * | 11/2005 | Noguchi et al. | 473/328 |
| 7,160,205 | B2 | | 1/2007 | Yamamoto | |
| 7,163,468 | B2 | * | 1/2007 | Gibbs et al. | 473/329 |
| 7,166,038 | B2 | * | 1/2007 | Williams et al. | 473/329 |
| 7,169,060 | B2 | * | 1/2007 | Stevens et al. | 473/329 |

(Continued)

FOREIGN PATENT DOCUMENTS

JP 10-33724 A 2/1998

(Continued)

*Primary Examiner* — Alvin A Hunter

(74) *Attorney, Agent, or Firm* — Birch, Stewart, Kolasch & Birch, LLP

(57) ABSTRACT

Golf club head 2 is provided including face member 4, crown member 6, sole member 8 and recessed part 10. The recessed part 10 is provided around the sole member 8. The recessed part 10 has a maximum height Hm of equal to or greater than 10 mm. The projected area S1 of the sole member 8 projected on the reference plane accounts for 40% or more and 65% or less of the projected area S2 of the crown member 6 projected on the reference plane. The head 2 is hollow. Preferably, the maximum angle θm formed between the margin F1 of the recessed part 10 and the sole edge E1 in proximity thereto is equal to or greater than 45 degrees. Preferably, the curvature radius of the sole face in a toe-heel direction is 9.0 cm or greater and 11.5 cm or less. Preferably, the head 2 has a volume of 400 cc or more and 500 cc or less.

17 Claims, 11 Drawing Sheets

U.S. PATENT DOCUMENTS

| | | | | |
|---|---|---|---|---|
| 7,192,364 | B2 * | 3/2007 | Long | 473/329 |
| 7,278,927 | B2 * | 10/2007 | Gibbs et al. | 473/329 |
| 7,291,075 | B2 * | 11/2007 | Williams et al. | 473/329 |
| 7,306,527 | B2 * | 12/2007 | Williams et al. | 473/329 |
| 7,311,613 | B2 * | 12/2007 | Stevens et al. | 473/329 |
| 7,390,269 | B2 * | 6/2008 | Williams et al. | 473/329 |
| 7,407,448 | B2 * | 8/2008 | Stevens et al. | 473/329 |
| 7,419,440 | B2 * | 9/2008 | Williams et al. | 473/329 |
| 7,455,598 | B2 * | 11/2008 | Williams et al. | 473/329 |
| 7,476,161 | B2 * | 1/2009 | Williams et al. | 473/329 |
| 7,488,261 | B2 * | 2/2009 | Cackett et al. | 473/300 |
| 7,494,424 | B2 * | 2/2009 | Williams et al. | 473/329 |
| 7,559,851 | B2 * | 7/2009 | Cackett et al. | 473/300 |
| 2006/0281581 | A1 | 12/2006 | Yamamoto | |

FOREIGN PATENT DOCUMENTS

| | | | |
|---|---|---|---|
| JP | 2004-49559 | A | 2/2004 |
| JP | 2006-297117 | A | 11/2006 |
| JP | 2006-340846 | A | 12/2006 |

* cited by examiner

GOLF CLUB HEAD

This application claims priority on Patent Application No. 2007-016694 filed in JAPAN on Jan. 26, 2007. The entire contents of this Japanese Patent Application are hereby incorporated by reference.

BACKGROUND OF THE INVENTION

1. Field of the Invention

The present invention relates to a hollow golf club head.

2. Description of the Related Art

Performances desired for hollow golf club heads include hitting sound, resilience, moment of inertia, ease of setting, and the like. Hitting sound of the hollow golf club head is loud. With respect to the hollow golf club heads, improvement of hitting sound has been desired. Clear hitting sound with high frequency is apt to be preferred. In addition, the hollow golf club head has a large volume. Large heads may be difficult in setting. Ease of setting correlates with the extent of setting stability. The term extent of setting stability means the extent of stability of the head in addressing. The heads with inferior setting stability are not stable in addressing.

Proposals for improvement of the hitting sound have been made. Japanese Unexamined Patent Application Publication No. Hei 10-33724 discloses a head provided with a Y-shaped metal inside the head for improving the hitting sound. Japanese Unexamined Patent Application Publication No. 2002-126136 discloses a head provided with a linear protrusion inside the head for improving the hitting sound. Japanese Unexamined Patent Application Publication No. 2004-49559 discloses a head with a devised sole for improving the hitting sound. Japanese Unexamined Patent Application Publication No. 2004-49733 discloses a head with a devised thickness of the sole for improving the hitting sound. United States patent corresponding to Japanese Unexamined Patent Application Publication No. 2002-126136 is U.S. Pat. No. 6,645,087. United States patent corresponding to Japanese Unexamined Patent Application Publication No. 2004-49733 is U.S. Pat. No. 7,160,205.

SUMMARY OF THE INVENTION

In the prior art described in the foregoing, the performances other than the hitting sound are not necessarily satisfactory. Furthermore, the head described in Japanese Unexamined Patent Application Publication No. Hei 10-33724 necessitates a large weight for the Y-shaped metal, whereby design freedom of the head is significantly reduced. In addition, the Y-shaped metal may be detached due to impact in hitting.

The present inventor found a novel head which can improve a variety of performances of the hollow head in addition to the improvement of the hitting sound. An object of the present invention is to provide a golf club head enabling improvement of the hitting sound, and also enabling a variety of other performances to be improved.

The golf club head according to the present invention has a face member, a crown member, a sole member and a recessed part. This recessed part is provided around the sole member. The recessed part has a maximum height Hm of equal to or greater than 10 mm. The projected area S1 of the sole member projected on the reference plane accounts for 40% or more and 65% or less of the projected area S2 of the crown member projected on the reference plane. This golf club head is hollow.

Preferably, the maximum angle θm formed between the margin of the recessed part and the sole edge in proximity thereto is equal to or greater than 45 degrees.

Preferably, the curvature radius of the sole face in a toe-heel direction is 9.0 cm or greater and 11.5 cm or less.

Preferably, the head volume is 400 cc or more and 500 cc or less.

According to the present invention, a hollow golf club head that is favorable in hitting sound with high performances can be obtained.

DESCRIPTION OF THE PREFERRED EMBODIMENTS

Hereinafter, the present invention will be explained in detail by way of preferred embodiments with appropriate reference to the accompanying drawings.

Figure 4:
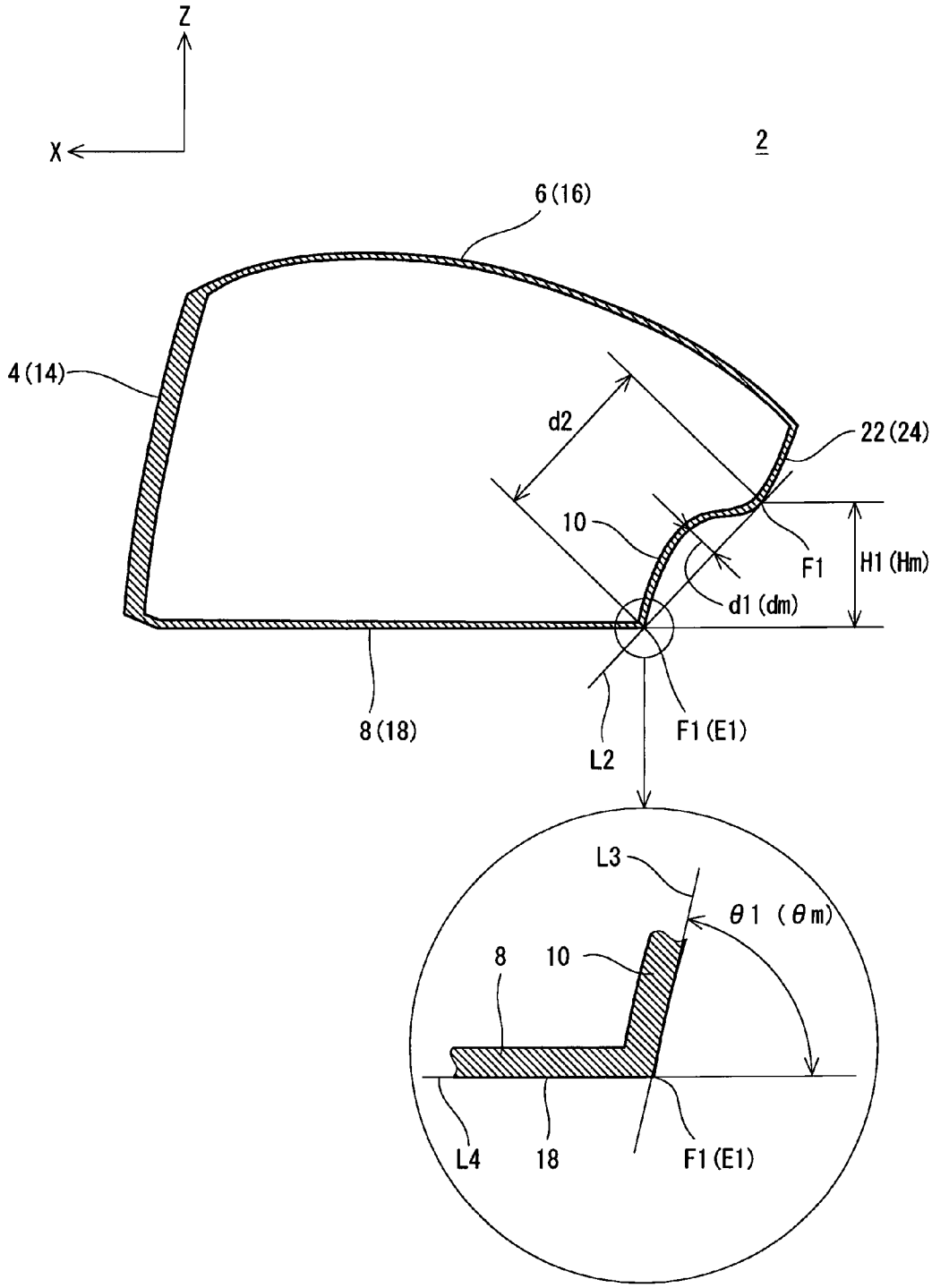
FIG. 4 shows a cross-sectional view taken along the line IV-IV of FIG. 1.

Head 2 has face member 4, crown member 6, sole member 8, recessed part 10 and hosel part 12. The external surface of the face member 4 corresponds to face surface 14. The external surface of the crown member 6 corresponds to crown face 16. The crown face 16 smoothly continues. The external surface of the sole member 8 corresponds to sole face 18. The hosel part 12 has shaft hole 20. As shown in FIG. 4, The head 2 has a hollow space inside thereof. The head 2 is a hollow golf club head. The head 2 is a wood golf club. Preferable heads in the present invention are heads for driver, heads for fairway wood, and heads for utility club, and particularly, preferably, heads for driver, and heads for fairway wood.

Furthermore, the head 2 has a side member 22. The external surface of the side member 22 corresponds to side face 24. The side member 22 is positioned between the crown member 6 and the sole member 8. It is acceptable that there exists no side member 22.

The recessed part 10 is provided around the sole member 8. The recessed part 10 is provided between the sole member 8 and the side member 22. The recessed part 10 is in proximity to or adjacent to the sole member 8. The recessed part 10 is adjacent to the sole face 18. The external surface of the recessed part 10 continues to the sole face 18.

At least a part of the sole face 18 can be in contact with the reference plane in the reference state described below. The sole face 18 is a face which continues almost smoothly. However, in the present invention, the level difference of less than 5 mm may not define the external margin (sole edge) of the sole face 18. The external side with the level difference of less than 5 mm is also included in the sole face 18. Grooves or recessed parts (logo and the like) having a height or depth of less than 5 mm can be also included in the sole face 18. When the external margin of the sole face 18 at the part adjacent to the recessed part 10 is indefinite, margin F1 of the recessed part 10 (described later) can correspond to the sole edge.

The recessed part 10 is provided at a part which can be generally referred to as sole member and/or side member. However, in the present invention, the sole member 8 is distinguished from the recessed part 10. Still further, the recessed part 10 is distinguished from the side member 22.

In the present invention, the reference state of the head is defined. This reference state is a state in which the head is placed on horizontal plane V1 in accordance with predetermined lie angle and real loft angle. The predetermined lie angle and the real loft angle are, for example, values provided in product catalog.

Figure 1:
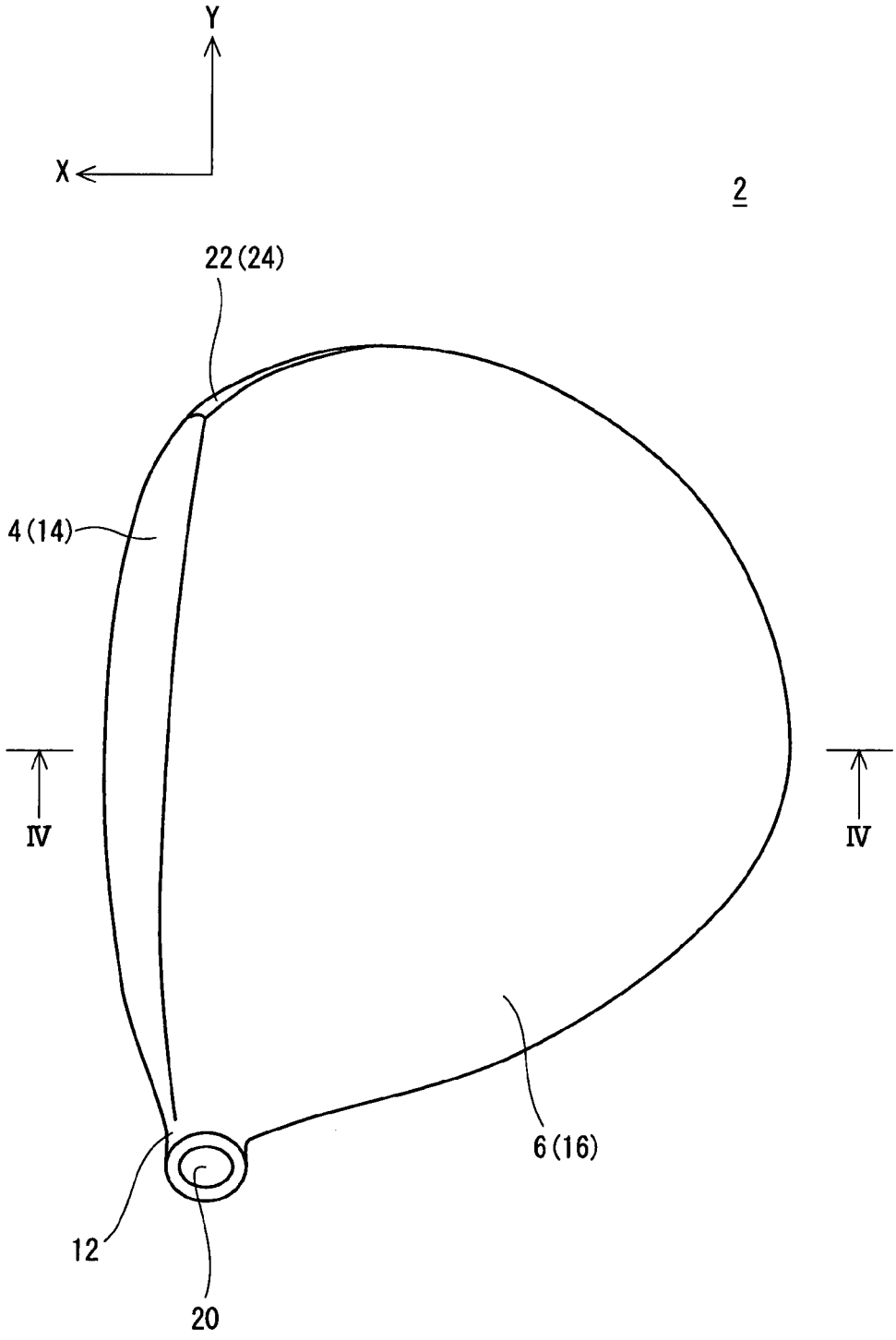
FIG. 1 shows a view illustrating a head according to a first embodiment of the present invention viewed from the crown side.

In the present invention, straight line L1, X axis, Y axis and Z axis are defined. The straight line L1 (not shown in the Figure) is a perpendicular line drawn from the center of gravity of the head to the face surface 14. The straight line L1 passes the center of gravity of the head, and the sweet spot. The X axis is a projected image generated by projecting the straight line L1 onto the horizontal plane V1. This projection is oriented along a perpendicular direction with respect to the horizontal plane V1. The Y axis is parallel to the horizontal plane V1, and is perpendicular to the X axis. The Z axis is perpendicular to the X axis, and is perpendicular to the Y axis. In FIG. 1 and FIG. 4, direction of each axis is shown. The horizontal plane V1 corresponds to the reference plane in the present invention. In the present invention, the direction of the Z axis corresponds to the vertical direction. In the present invention, the direction along the Y axis corresponds to the toe-heel direction. In the present invention, the direction along the X axis corresponds to the face-back direction. In the present invention, the direction along the X axis corresponds to the anterior-posterior direction.

The margin F1 of the recessed part 10 is a boundary of the recessed part 10 and other part. The margin F1 of the recessed part 10 is defined as follows. A cross section of the head on a plane PL1 that is parallel to the X axis and the Z axis is envisioned. This plane PL1 can be established at any position along the Y axial direction. FIG. 4 shows an example of a cross section with respect to the plane PL1. In the cross section with respect to the plane PL1, a straight line L2 in contact with the external surface of the head while the recessed part 10 is covered is envisioned (see, FIG. 4). The intersection of this straight line L2 and the head of the recessed part 10 corresponds to the margin F1. The plane PL1 can be established at any position along the Y axial direction. Also the cross section with respect to this plane PL1 is established at any position along the Y axial direction. The margin F1 of the recessed part 10 is also established at any position along the Y axial direction.

In FIG. 4, what is indicated by a both-oriented arrowhead H1 is the height of the margin F1. The height H1 is a distance between two margins F1 in the Z axial direction. The height H1 is a width of the recessed part 10 in the Z axial direction. The height H1 can be established at any position along the Y axial direction. The height H1 can vary depending on the position of the Y axial direction. The maximum height Hm is a maximum value among the heights H1.

When the maximum height Hm is great, the area of the sole member 8 is likely to be small. The sole member 8 vibrates upon impact. The number of vibration of the sole member 8 having a small area is great. Due to the great number of vibration, high hitting sound is likely to be generated. The high hitting sound is apt to be preferred by golf players. When the maximum height Hm is great, the surface area S3 of the external surface of the recessed part 10 is likely to be large. Upon hitting, stress is likely to be concentrated to the recessed part 10. By increasing the surface area S3, the stress concentration to the recessed part 10 can be moderated. Such moderation can contribute to improvement of durability of the head. In these respects, the maximum height Hm is preferably equal to or greater than 10 mm, more preferably equal to or greater than 12 mm, and particularly preferably equal to or greater than 15 mm. Because of limitation of the head size, the maximum height Hm is preferably equal to or less than 40 mm, more preferably equal to or less than 30 mm, and still more preferably equal to or less than 25 mm.

In light of improving the effect achieved by the recessed part 10, the surface area S3 of the recessed part 10 is preferably equal to or greater than 5 $cm^2$, and more preferably equal to or greater than 10 $cm^2$. In light of prevention of the projected area S1 of the sole member 8 from becoming too small, the surface area S3 of the recessed part 10 is preferably equal to or less than 50 $cm^2$. When there are two or more recessed parts 10, the surface area S3 falls under total surface area of the two or more recessed parts 10.

In the present invention, the projected area S1 of the sole member 8, and the projected area S2 of the crown member 6 are defined. The projected area S1 is a projected area of the sole face 18 projected to the reference plane on the head in the reference state described above. The direction of this projection is a perpendicular direction with respect to the reference plane. The projected area S2 is a projected area of the crown face 16 projected to the reference plane on the head in the reference state described above. The direction of this projection is perpendicular with respect to the reference plane.

The projected area S1 of the sole member 8 is smaller than the projected area S2 of the crown member 6. Small projected area S1 is likely to result in high frequency of the hitting sound. Furthermore, when the projected area S1 is narrow, increase in the head weight is diminished even though the thickness of the sole member 8 is increased. Therefore, when the projected area S1 is small, thickness of the sole member 8 can be easily increased. The thick sole member 8 further increased the number of vibration of the sole member 8.

In light of improvement of the setting stability, the projected area S1 of the sole member 8 is preferably equal to or greater than 40%, more preferably equal to or greater than 41%, still more preferably equal to or greater than 45%, and yet further preferably equal to or greater than 53% of the projected area S2 of the crown member 6. In light of attaining a high hitting sound, the projected area S1 of the sole member 8 is preferably equal to or less than 65%, more preferably equal to or less than 62%, and still more preferably equal to or less than 60% of the projected area S2 of the crown member 6.

When the projected area S2 of the crown member 6 is too small, the head volume is likely to be decreased. For increasing the head volume while keeping the projected area S2 small, it would be necessary to increase the height of the head. Typical example in which the head height is elevated may include deep face head, generally referred to. When the head height is increased too much, the center of gravity of the head becomes excessively high. When the center of gravity of the head is elevated, back spin rate is likely to be increased due to so called gear effect. When the center of gravity of the head is elevated, the flight distance is likely to be decreased. In this respect, the projected area S2 is preferably equal to or greater than 80 $cm^2$, and more preferably equal to or greater than 90 $cm^2$. When the projected area S2 is too great, the player may feel discomfort in addressing. In addition there is a restriction in regulation for enlargement of the crown member 6. The rule directed by Japan Golf Association defines that the length from the heel to the toe of the head must be equal to or less than 5 inches. Moreover, this rule defines that the length from the heel to the toe of the head must be longer than the length of from the face to the back. In light of suppression of the discomfort in addressing, and obeying of the rules, the projected area S2 is preferably equal to or less than 150 $cm^2$, and more preferably equal to or less than 130 $cm^2$.

In light of improvement of the setting stability, the projected area S1 of the sole member 8 is preferably equal to or greater than 40 $cm^2$, more preferably equal to or greater than 45 $cm^2$, and still more preferably equal to or greater than 50 $cm^2$. In light of attaining a high hitting sound, the projected area S1 is preferably equal to or less than 75 $cm^2$, more preferably equal to or less than 65 $cm^2$, and still more preferably equal to or less than 60 $cm^2$.

When the recessed part 10 is replaced by a flat shape, the surface area of the replaced part becomes smaller the recessed part 10. To the contrary, through replacing the flat part by the recessed part 10, the surface area is increased. The replacement of the flat shape by the recessed part 10 leads to increase in the weight of the replaced part. This increase in the weight is apt to result in increase in the moment of inertia of the head.

In FIG. 4, what is indicated by the both-oriented arrowhead d1 is the depth of the recessed part 10. In light of increase in the moment of inertia of the head, the maximum value dm of the depth d1 is preferably equal to or greater than 2 mm, and more preferably equal to or greater than 3 mm. In light of facilitating the manufacture of the head, the maximum depth dm is preferably equal to or less than 20 mm, and more preferably equal to or less than 15 mm. The depth d1 is measured in the cross section with respect to the aforementioned plane PL1. The maximum value of the depth in the cross section with respect to the plane PL1 corresponds to the depth d1. This depth d1 is determined at each position of all the Y axial directions. The maximum value of the depths d1 corresponds to the maximum depth dm.

In FIG. 4, what is indicated by the both-oriented arrowhead d2 is the length between both margins F1 on the straight line L2. In light of increase in the moment of inertia of the head, the maximum value dy of the length d2 is preferably equal to or greater than 12 mm, and more preferably equal to or greater than 15 mm. In light of suppression of excessive decrease in the projected area S1 of the sole member, and improvement of the setting stability, the maximum value dy is preferably equal to or less than 50 mm, and more preferably equal to or less than 40 mm. The length d2 is measured in the cross section with respect to the aforementioned plane PL1. The length d2 is determined at each position of all the Y axial directions. The maximum value of the lengths d2 corresponds to the maximum value dy.

Figure 2:
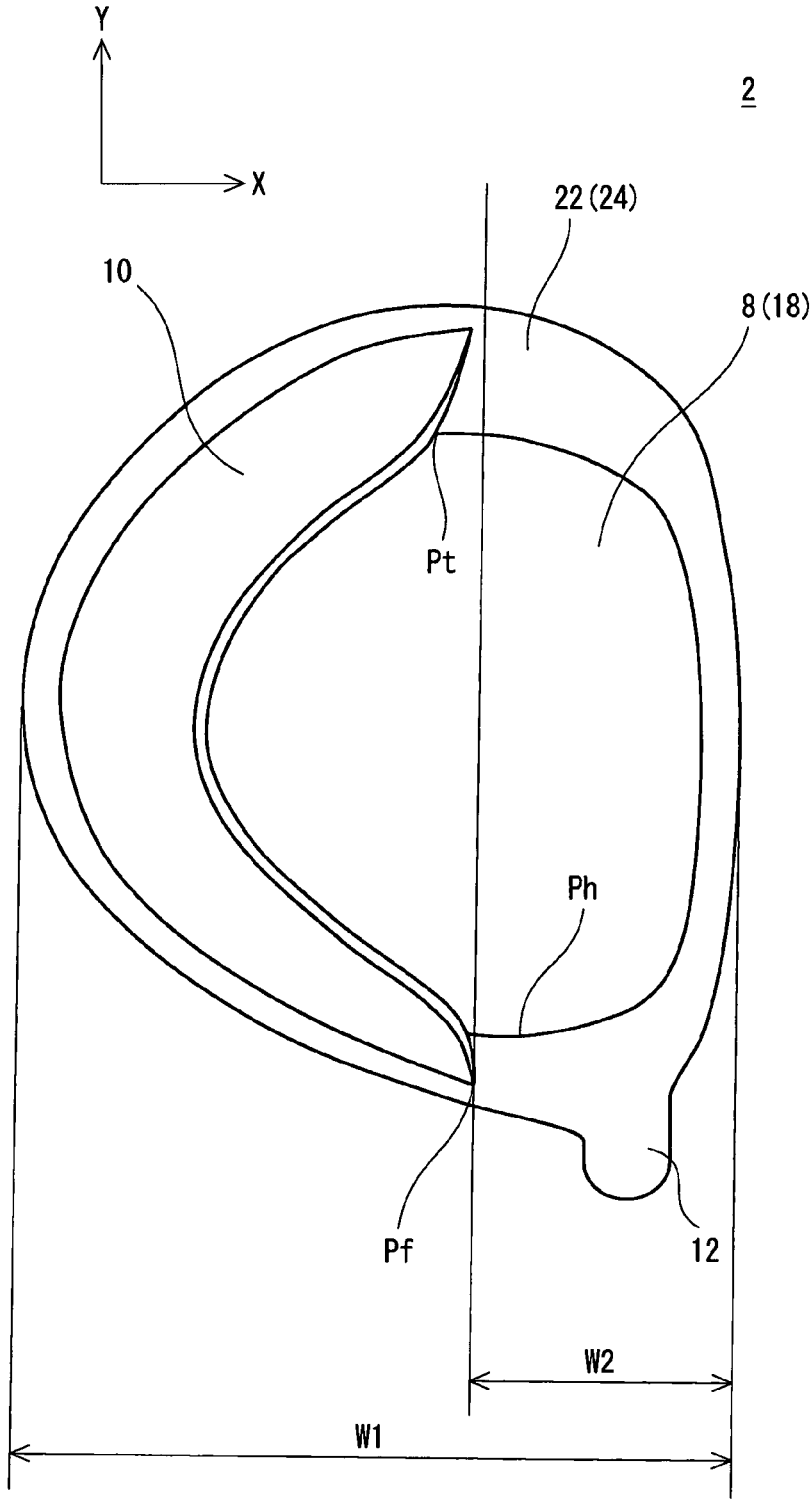
FIG. 2 shows a view illustrating the head shown in FIG. 1 viewed from the sole side.
Figure 3:
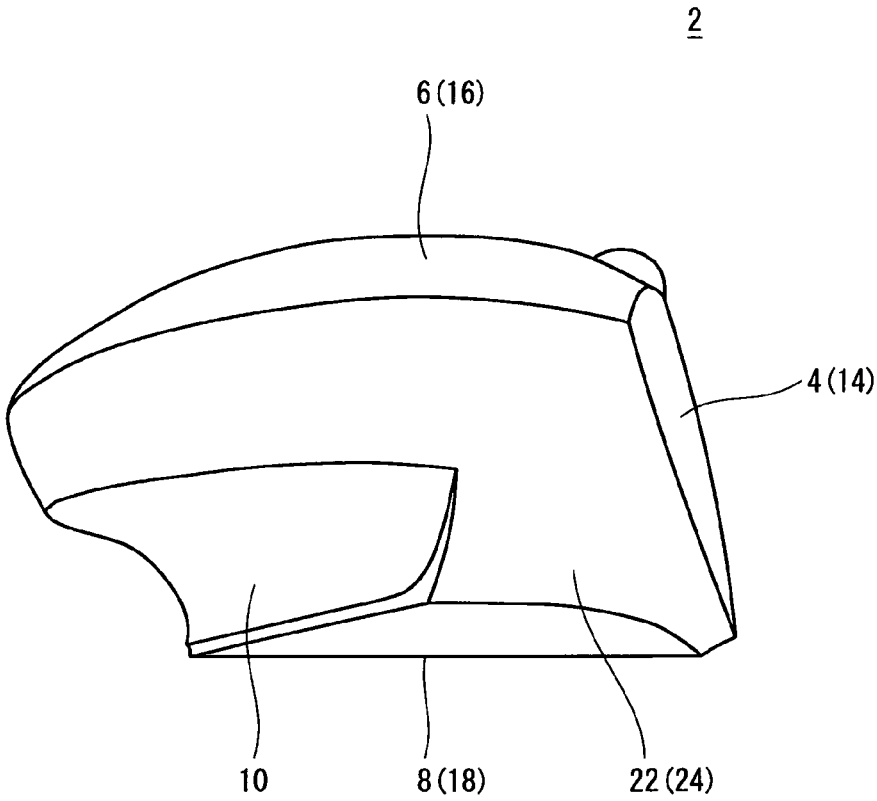
FIG. 3 shows a view illustrating the head shown in FIG. 1 viewed from the toe side.

In FIG. 2, what is indicated by the symbol Pf is the edge of a most face side in the recessed part 10. In FIG. 2, what is indicated by the both-oriented arrowhead W1 is a maximum width of the head in the X axial direction. In FIG. 2, what is indicated by the both-oriented arrowhead W2 is the length in the X axial direction between the forefront edge and the edge Pf of the recessed part 10 of the head. In light of placement of the recessed part 10 on the back side, the value [W2/W1] is preferably equal to or greater than ¼. By placing the recessed part 10 on the back side, it is likely that the setting stability is improved, and that the center of gravity of the head is lowered. When there are two or more recessed parts, the headmost edge among the forefront edges of each recessed part is defined as the edge Pf.

In FIG. 4, what is indicated by the both-oriented arrowhead θ1 is an angle formed between the margin F1 of the recessed part 10, and the sole edge E1 in proximity to this margin F1. The angle θ1 is determined between the margin F1 on the side of the sole member 8, and the sole edge E1 that is in proximity thereto.

The angle θ1 is determined by the cross section with respect to the plane PL1, or the cross section with respect to the plane PL2. The plane PL1 is as described above. The plane PL2 is a plane that is parallel to the Y axis and Z axis. The angle θ1 can be determined at any position along the X axial direction and the Y axial direction. In the cross section with respect to the plane PL1 or the plane PL2, a tangent line L3 at a point 3 mm away from the margin F1 to the side of the recessed part 10, and a tangent line L4 at a point 3 mm away from the sole edge E1 to the side of the sole member 8 can be established. The angle θ1 is an angle formed between the tangent line L3 and the tangent line L4. The angle θ1 can vary depending on the position of the X axial direction or the Y axial direction. The maximum angle θm is a maximum value among all angles θ1. In the embodiment shown in FIG. 4, the margin F1 agrees with the sole edge E1. It is acceptable that the margin F1 does not agree with the sole edge E1.

When the maximum angle θm is small, boundary of the sole member 8 and the recessed part 10 gets closer to flat. Therefore, the sole member 8 is likely to be deformed, while the number of vibration of the sole member 8 is likely to be decreased. In light of attaining of a high hitting sound, the maximum angle θm is preferably equal to or greater than 45 degrees, more preferably equal to or greater than 50 degrees, still more preferably equal to or greater than 55 degrees, and yet more preferably equal to or greater than 65 degrees. In light of moderation of the stress concentration to the margin F1 or the sole edge E1, the maximum angle θm is preferably equal to or less than 120 degrees, more preferably equal to or less than 90 degrees, and still more preferably equal to or less than 85 degrees.

In light of improvement of the setting stability, the curvature radius R1 of the sole face 18 is preferably equal to or greater than 9.0 cm. In light of increase in the number of vibration of the sole member 8, and attaining of a high hitting sound, the curvature radius R1 is preferably equal to or less than 11.5 mm. This curvature radius R1 a curvature radius in a toe-heel direction. This curvature radius R1 is measured in the cross section with respect to the aforementioned plane PL2.

In the head in the aforementioned reference state, the profile line in contact with the horizontal plane V1 preferably has a straight line L5 which is parallel to the horizontal plane V1, among profile lines on the sole face 18 with respect to the aforementioned plane PL1. Accordingly, the setting stability of the head 2 is improved. In light of improvement of the setting stability, the length of the straight line L5 accounts for preferably 50% or more of the entire length of the profile line of the sole face 18 including this straight line L5.

In the head in the aforementioned reference state, the coordinate on the Z axis, i.e., Z coordinate is envisaged. The value of this Z coordinate is greater as it is positioned upper side. This Z coordinate is represented by a plus value on the upper side. The Z coordinate at a point Pt on the most toe side on the sole face 18 is defined as ZT (mm), and the Z coordinate at a point Pc on the undermost side on the sole face 18 is defined as ZC (mm). In addition, the Z coordinate at a point Ph on the most heel side on the sole face 18 is defined as ZH (mm). In light of preventing the sole member 8 from deformation, and attaining of a high hitting sound, the value [ZT−ZC] is preferably equal to or greater than 5 mm, more preferably equal to or greater than 8 mm, and still more preferably equal to or greater than 10 mm. In light of lowering of the center of gravity of the head to improve the performances in hitting of the ball, the value [ZT−ZC] is preferably equal to or less than 20 mm, more preferably equal to or less than 18 mm, and still more preferably equal to or less than 15 mm. In light of preventing the sole member 8 from deformation, and attaining of a high hitting sound, the value [ZH−ZC] is preferably equal to or greater than 5 mm, more preferably equal to or greater than 8 mm, and still more preferably equal to or greater than 10 mm. In light of lowering of the center of gravity of the head to improve the performances in hitting of the ball, the value [ZH−ZC] is preferably equal to or less than 20 mm, more preferably equal to or less than 18 mm, and still more preferably equal to or less than 15 mm.

In light of attaining a more favorable hitting sound, it is preferred that the Z coordinate of the line L6 connecting the point Pt and the point Pc drawn on the sole face 18 at a minimum distance gradually increased from the point Pc to the point Pt. In light of attaining a more favorable hitting sound, it is preferred that the Z coordinate of the line L7 connecting the point Ph and the point Pc drawn on the sole face 18 at a minimum distance gradually increased from the point Pc to the point Ph. When the Z coordinate of the line L6 or line L7 is altered stepwise or abruptly, the hitting sound is likely to be deteriorated because almost plane part may be readily generated on the sole face 18. When there exist multiple points Pc, it is preferred that the Z coordinate of the line L6 or line L7 gradually increases as described above with respect to at least one point Pc. More preferably, the Z coordinates of the lines L6 or lines L7 may gradually increase as described above with respect to all the points Pc.

In light of improvement of the resilience performance accompanied by ease in adjusting the timing of the swing, the head weight is preferably equal to or greater than 180 g. When the head is too heavy, the club cannot be swung through, whereby the flight distance or the directionality of the hit ball is likely to be inferior. In this respect, the head weight is preferably equal to or less than 210 g.

A groove may be also provided on the sole member. The groove can increase the rigidity around the groove, and the frequency of the sole vibration can be increased. The shape of the groove is not particularly limited. In light of facilitating the manufacture, the width of the groove is preferably equal to or greater than 0.5 mm, more preferably equal to or greater than 1 mm, and particularly preferably equal to or greater than 2 mm. The width of the groove being too great results in a state approximate to the state in which no groove is provided, whereby the effect of the groove may be hardly achieved. In this respect, the width of the groove is preferably equal to or less than 10 mm, more preferably equal to or less than 8 mm, and particularly preferably equal to or less than 5 mm. The depth of the groove being too small results in a state approximate to the state in which no groove is provided, whereby the effect of the groove may be hardly achieved. In this respect, the depth of the groove is preferably equal to or greater than 0.5 mm, and more preferably equal to or greater than 1 mm. When the groove is too deep, rigidity of the groove part is deteriorated, whereby the number of vibration of the sole member 8 may be decreased. Additionally, too deep groove may lead to increase in probability of generation of a crack that begins at the groove. In these respects, the depth of the groove is preferably equal to or less than 5 mm, and more preferably equal to or less than 3 mm.

A rib may be provided inside of the sole member. The protrusion can increase the rigidity of the sole member, whereby high hitting sound is likely to be attained. In light of improvement of the hitting sound, the width of the rib is preferably equal to or greater than 0.5 mm, and more preferably equal to or greater than 0.8 mm. In light of suppression of increase in the weight of the sole member, the width of the rib is preferably equal to or less than 2 mm, and more preferably equal to or less than 1.5 mm. In light of improvement of the hitting sound, the height of the rib is preferably equal to or greater than 0.2 mm, and more preferably equal to or greater than 0.5 mm. In light of suppression of increase in weight of the sole member, the height of the rib is preferably equal to or less than 2 mm, and more preferably equal to or less than 1 mm.

The method of manufacturing the head is not limited. Examples of the method of manufacture include casting, forging, pressing and the like. The hollow head can be obtained by joining two or more members. For the joining, welding can be adopted. For example, a head obtained by welding of a face member and a head main body may be illustrated.

The thickness of each part of the head is not limited. In light of enhancement of the strength, the crown member has a thickness of preferably equal to or greater than 0.3 mm. In light of increase in size of the head with a limited head weight, the crown member has a thickness of preferably equal to or less than 1.2 mm. In light of enhancement of the strength, the side member has a thickness of preferably equal to or greater than 0.3 mm. In light of increase in size of the head with a limited head weight, the side member has a thickness of preferably equal to or less than 1.2 mm. In light of enhancement of the strength, and lowering of the center of gravity of the head, the sole member has a thickness of preferably equal to or greater than 0.8 mm. In light of increase in size of the head with a limited head weight, the sole member has a thickness of preferably equal to or less than 3.0 mm. In light of enhancement of the strength, the face member has a thickness of preferably equal to or greater than 2.5 mm. In light of increase in size of the head with a limited head weight, the face member has a thickness of preferably equal to or less than 4.0 mm. In light of enhancement of the strength, and increase in the moment of inertia of the head, the recessed part has a thickness of preferably equal to or greater than 0.3 mm, and more preferably equal to or greater than 0.8 mm. In light of increase in size of the head with a limited head weight, the recessed part has a thickness of equal to or less than 3.0 mm, and more preferably equal to or less than 1.2 mm.

The material of the head is not limited. Examples of the material of the head include metals, CFRP (carbon fiber reinforced plastics), and the like. As the metal, one or more of stainless steel, maraging steel, titanium, titanium alloy, magnesium alloys and amorphous alloys are preferred. As a part of the head, a weight member having a large specific gravity may be also used.

In light of improvement of the resilience coefficient, increase in the moment of inertia, and increase in the depth of the center of gravity, the head volume is preferably equal to or greater than 400 cc, more preferably equal to or greater than 420 cc, and still more preferably equal to or greater than 440 cc. In light of ease of setting, and ease in swinging, the head volume is preferably equal to or less than 500 cc, more preferably equal to or less than 480 cc, and still more preferably equal to or less than 460 cc.

Figure 5:
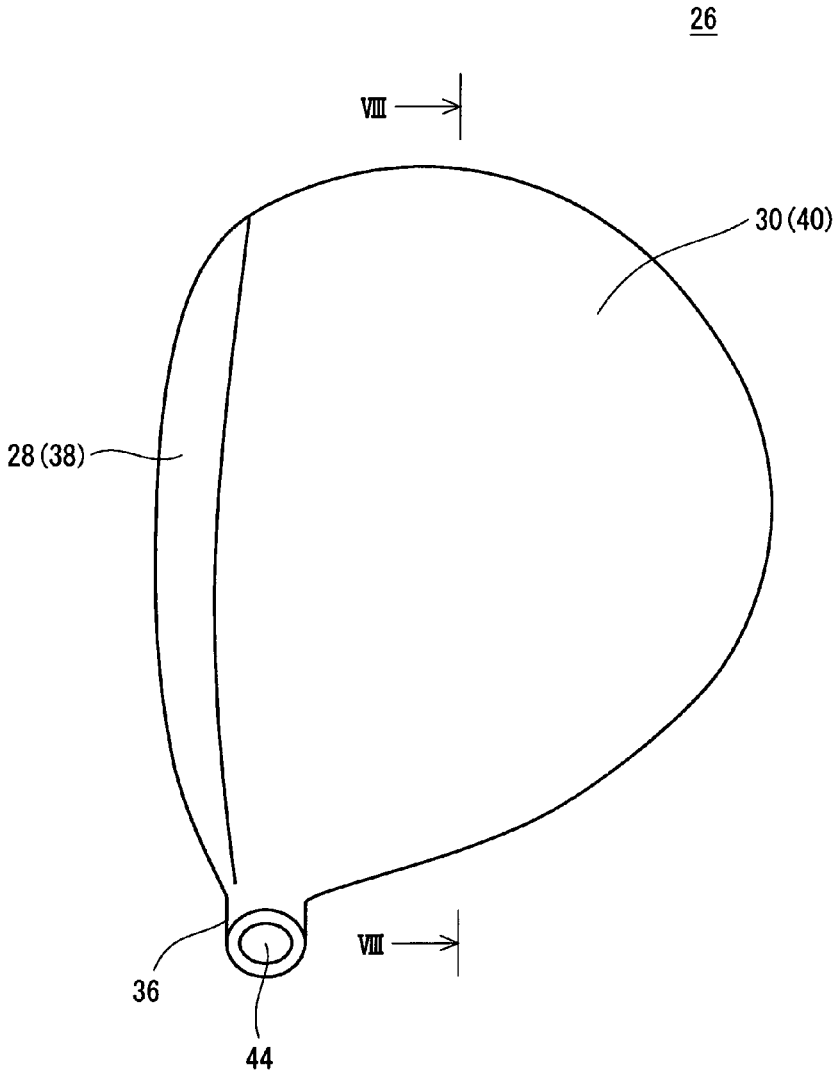
FIG. 5 shows a view illustrating a head according to a second embodiment of the present invention viewed from the crown side.
Figure 6:
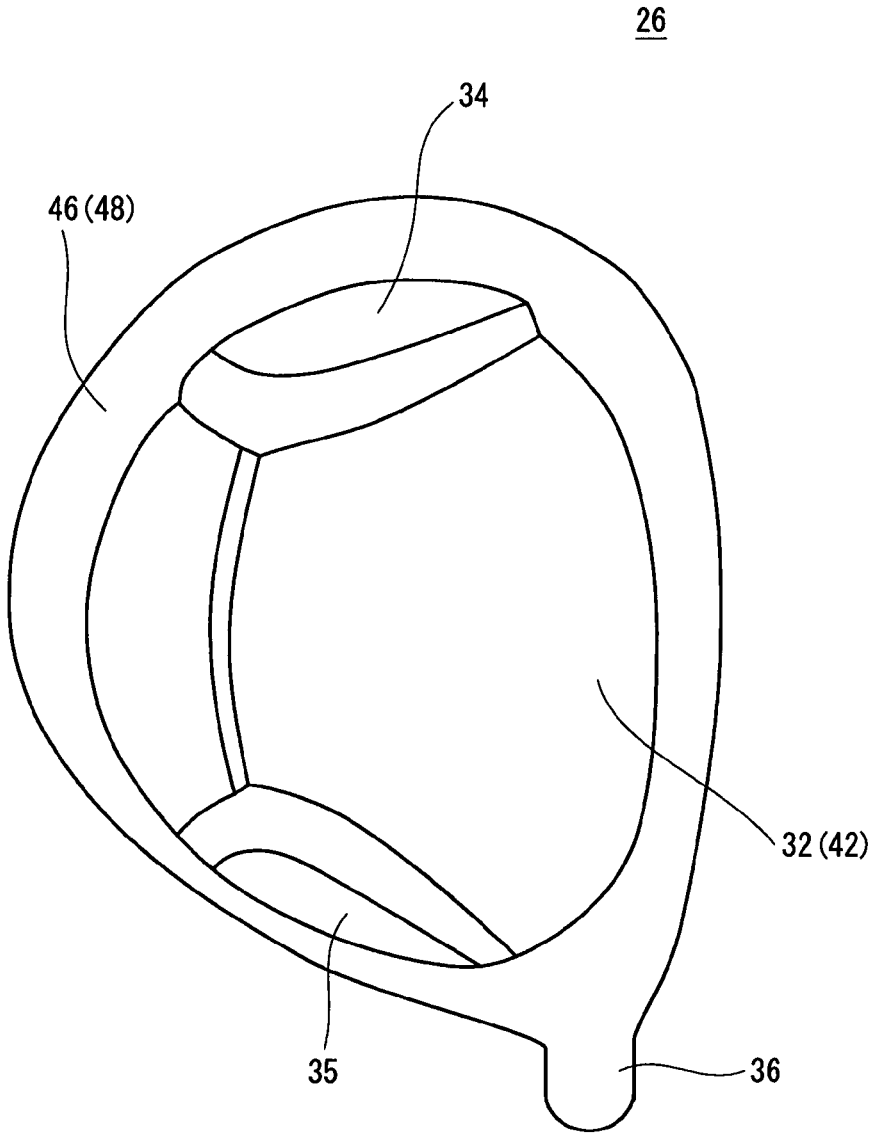
FIG. 6 shows a view illustrating the head shown in FIG. 5 viewed from the sole side.
Figure 7:
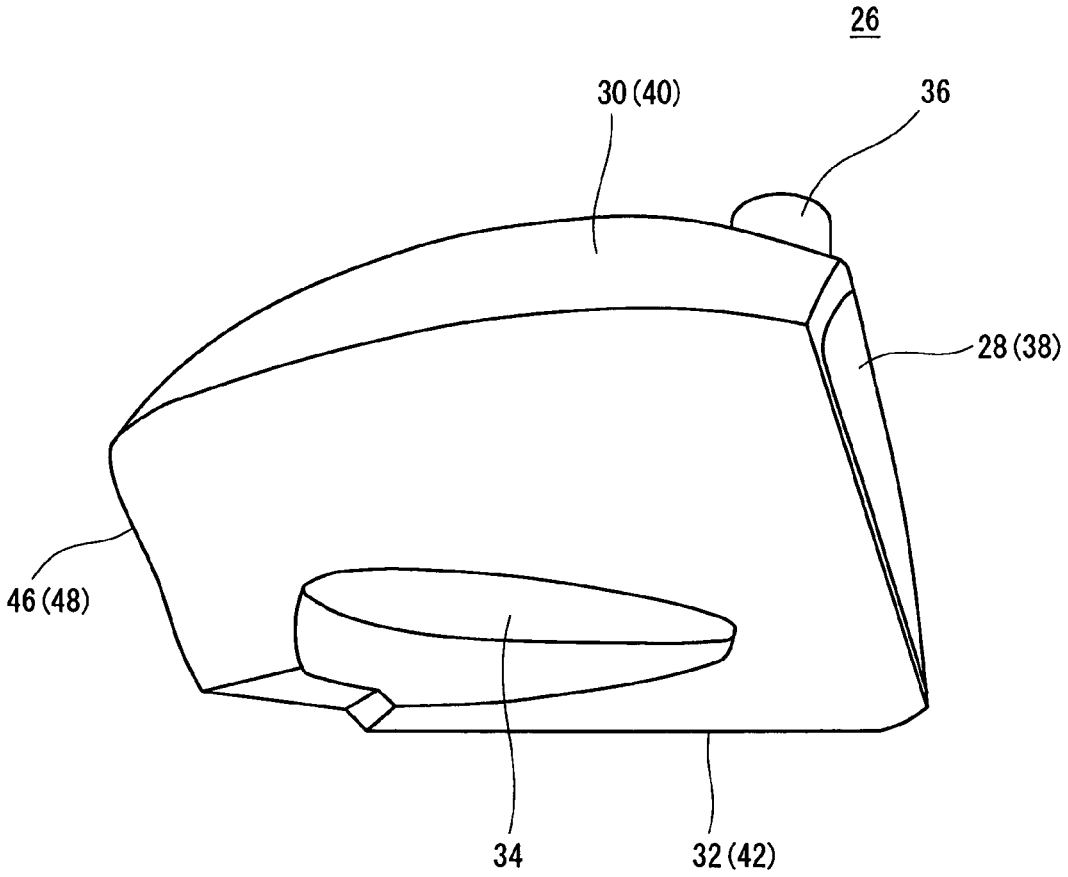
FIG. 7 shows a view illustrating the head shown in FIG. 5 viewed from the toe side.
Figure 8:
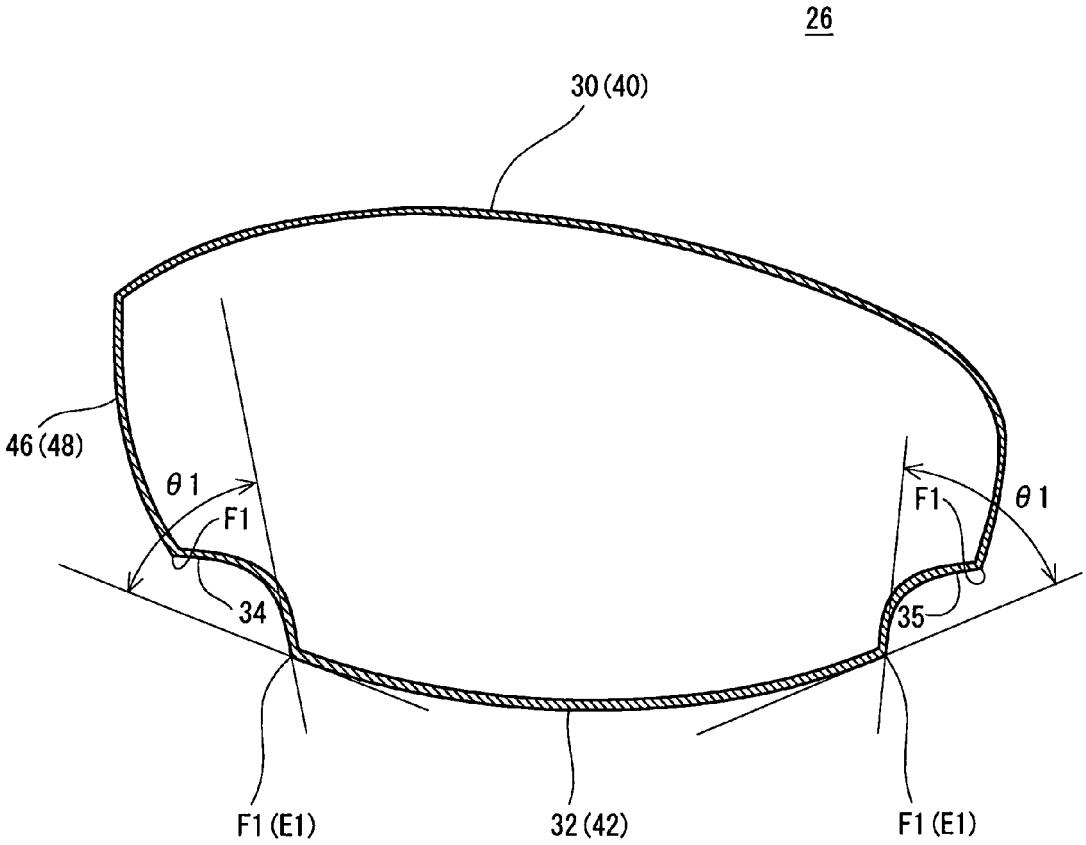
FIG. 8 shows a cross-sectional view taken along the line VIII-VIII of FIG. 5.

FIG. 5 shows a view illustrating golf club head 26 according to a second embodiment of the present invention viewed from the crown side. FIG. 6 shows a view illustrating the head 26 viewed from the sole side. FIG. 7 shows a view illustrating the head 26 viewed from the toe side. FIG. 8 shows a cross-sectional view taken along the line VIII-VIII of FIG. 5.

Head 26 has face member 28, crown member 30, sole member 32, recessed parts 34, 35 and hosel part 36. The head 26 has two recessed parts 34, 35. The external surface of the face member 28 corresponds to face surface 38. The external surface of the crown member 30 corresponds to crown face 40. The crown face 40 smoothly continues. The external surface of the sole member 32 corresponds to sole face 42. The hosel part 36 has shaft hole 44. As shown in FIG. 8, The head 26 has a hollow space inside thereof. The head 26 is a hollow golf club head. The head 26 is a wood golf club.

Furthermore, the head 26 has a side member 46. The external surface of the side member 46 corresponds to side face 48. The side member 46 is positioned between the crown member 30 and the sole member 32. It is acceptable that there exists no side member 46.

The recessed part 34 is provided around the sole member 32. The recessed part 34 is provided between the sole member 32 and the side member 46. The recessed part 34 is in proximity to or adjacent to the sole member 32. The recessed part 34 is adjacent to the sole face 42. The external surface of the recessed part 34 continues to the sole face 42.

The recessed part 35 is provided around the sole member 32. The recessed part 35 is provided between the sole member 32 and the side member 46. The recessed part 35 is in proximity to or adjacent to the sole member 32. The recessed part 35 is adjacent to the sole face 42. The external surface of the recessed part 35 continues to the sole face 42. The recessed part 35 is provided on the side closer to the heel than the recessed part 34.

FIG. 8 shows an example of the cross section with respect to the plane PL2 described above. FIG. 8 shoes an angle θ1 of the recessed part 34, and an angle θ1 of the recessed part 35. The head of the present invention may have two or more recessed parts.

EXAMPLES

Hereinafter, advantages of the present invention will be explained by way of Examples, however, the present invention should not be construed as being limited based on the description of the Examples.

Example 1

A face member was obtained by press molding of a plate material. The head main body was integrally molded by casting. The head main body includes a crown member, a sole member, a side member, a hosel part and a recessed part. The face member and the head main body were welded to obtain the head shown in from FIG. 1 to FIG. 4. The welding was carried out by plasma welding. The material of the face member was Ti-6Al-4V. The face member had a thickness of 3.3 mm at and in the vicinity of the sweet spot, and 2.5 mm at the surrounding area. The thickness of the crown member, and the thickness of the side member were 0.7 mm. The sole member had a thickness of 1.0 mm. The head volume was 460 cc; the head weight was 198 g; and the real loft was 10.5 degrees. Specifications and evaluation results of Example 1 are shown in the following Table 1.

Examples 2 to 5 and Comparative Example 3

The heads of Examples 2 to 5 and Comparative Example 3 were obtained in a similar manner to Example 1 except that the specifications were as shown in Table 1. Specifications and evaluation results of these examples are shown in the following Table 1.

Example 6

The head of Example 6 was obtained in a similar manner to Example 1 except that the head shape was as shown in from FIG. 5 to FIG. 8, and the specifications were as shown in Table 1. Specifications and evaluation results of Example 6 are shown in the following Table 1. In Example 6, both the maximum heights Hm of the two recessed parts were 15 mm. In Example 6, both the maximum angles θm of the two recessed parts were 64 degrees.

Comparative Example 1

Figure 9:
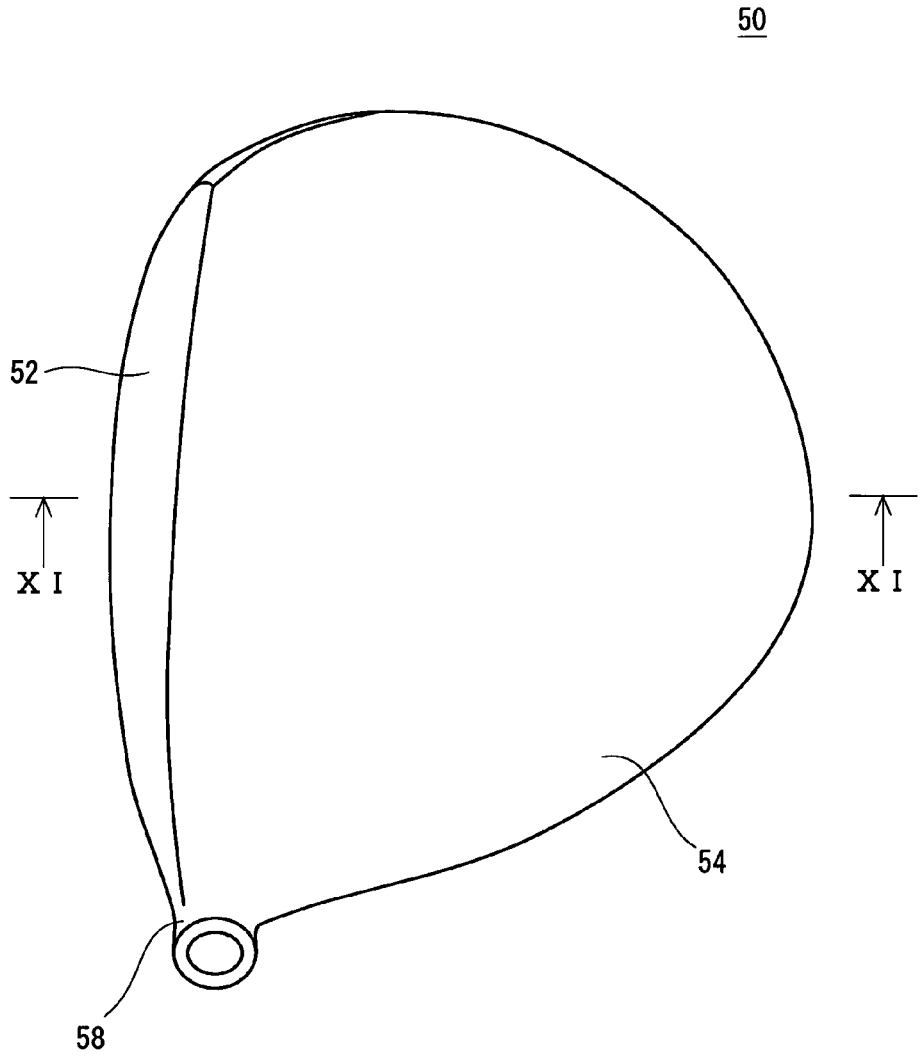
FIG. 9 shows a view illustrating a head of Comparative Example 1 viewed from the crown side.
Figure 10:
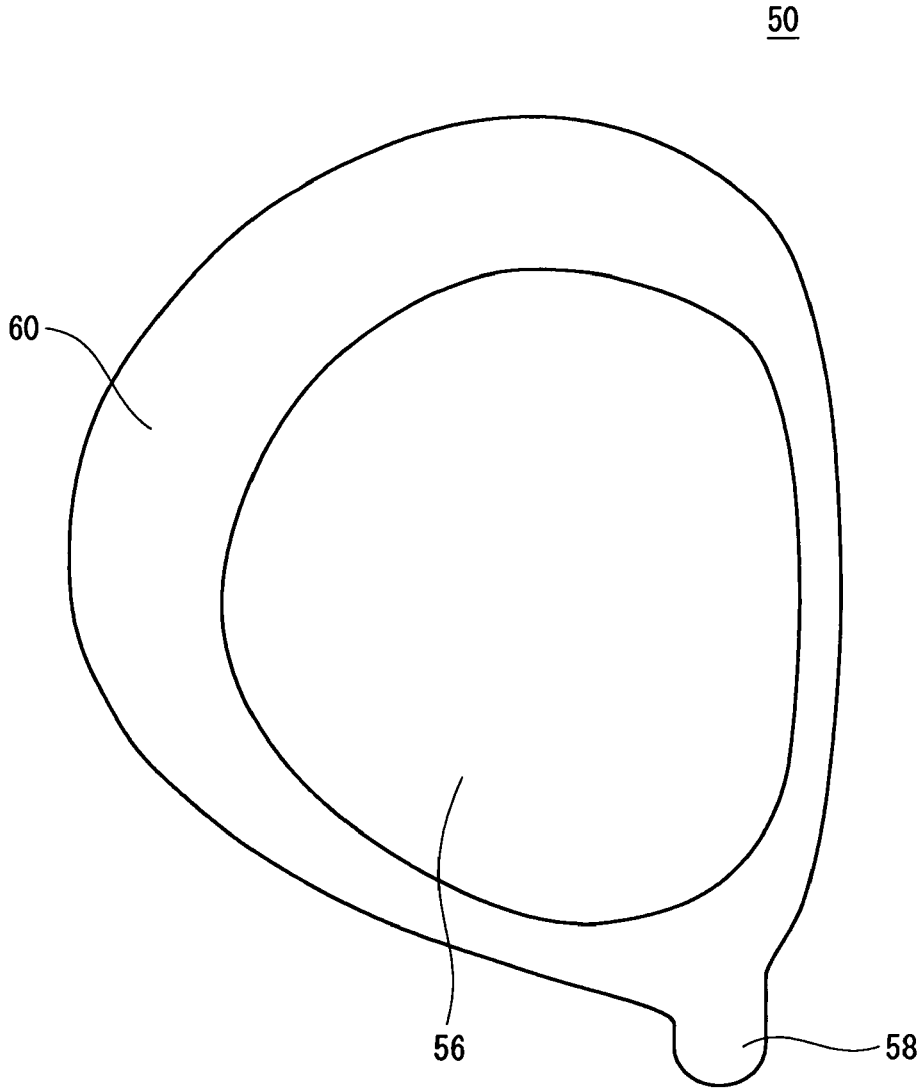
FIG. 10 shows a view illustrating the head shown in FIG. 9 viewed from the sole side.
Figure 11:
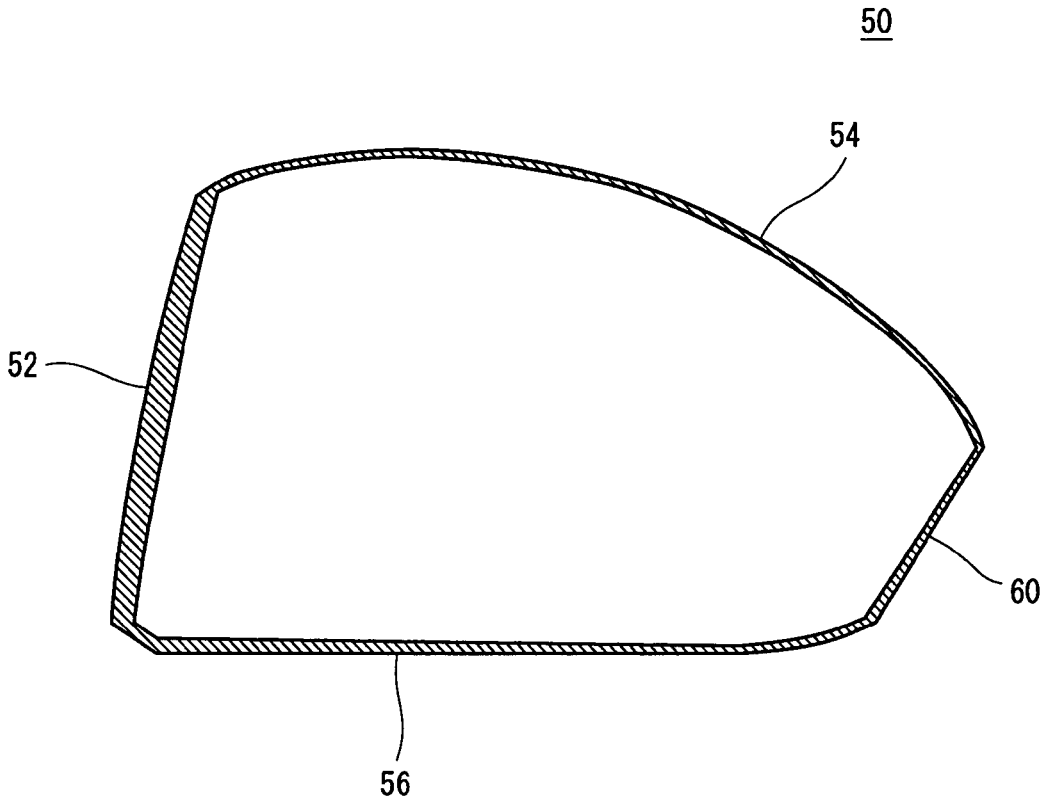
FIG. 11 shows a cross-sectional view taken along the line XI-XI of FIG. 9.

Head 50 of Comparative Example 1 is shown in from FIG. 9 to FIG. 11. The head 50 has face member 52, crown member 54, sole member 56 and hosel part 58. The head 50 does not have a recessed part such as the aforementioned recessed part 10, and recessed parts 34 and 35. As shown in FIG. 11, The head 50 has a hollow space inside thereof. The head 50 is a wood golf club. Furthermore, the head 50 has a side member 60. The side member 60 is positioned between the crown member 54 and the sole member 56. The head 50 of Comparative Example 1 was obtained in a similar manner to Example 1 except for the foregoings. Specifications and evaluation results of this Comparative Example 1 are shown in the following Table 1.

Comparative Example 2

The head of Comparative Example 2 was obtained in a similar manner to Comparative Example 1 except that the specifications were as shown in Table 1. Specifications and evaluation results of Comparative Example 2 are shown in the following Table 1.

Measurement of Lateral Moment of Inertia

The lateral moment of inertia was measured using MOMENT OF INERTIA MEASURING INSTRUMENT MODEL NO. 005-002 manufactured by INERTIA DYNAMICS INC. The lateral moment of inertia is a moment of inertia around an axis that passes the center of gravity of the head, and is parallel to the aforementioned Z axis. The measurement results are shown in the following Table 1.

Peak Frequency

A carbon shaft and a grip were attached to the head, whereby a golf club was produced. This golf club was mounted to a swing robot, and the golf balls were hit at a head speed of 40 m/s. Golf balls used were two-piece ball "SRIXON AD333" manufactured by SRI SPORTS LIMITED. The ball was teed, and hit. A microphone was placed at a position 30 cm away from the tee, at a position on the toe side of the head at impact. The recorded hitting sound was subjected to Fourier transformation with an FFT analyzer, and ⅓ octave band processing. The frequency of the highest sound pressure was determined as a peak frequency. The results of the measurement are shown in Table 1 below.

Sensuous Evaluation

Using a golf club to which each head was attached, ten golf players hit golf balls. Handicap of the ten golf players is in the range of 20 or lower. Comfort of the hitting sound was evaluated on a 5-point scale of from one to five. Higher score represents better evaluation. Average values rated by the ten golf players are shown in the following Table 1.

TABLE 1

Specifications and Evaluation Results of Examples and Comparative Examples

| | Comparative Example 1 | Comparative Example 2 | Comparative Example 3 | Example 1 | Example 2 | Example 3 | Example 4 | Example 5 | Example 6 |
|---|---|---|---|---|---|---|---|---|---|
| Figure | FIGS. 9 to 11 | FIGS. 9 to 11 | FIGS. 1 to 4 | FIGS. 1 to 4 | FIGS. 1 to 4 | FIGS. 1 to 4 | FIGS. 1 to 4 | FIGS. 1 to 4 | FIGS. 5 to 8 |
| Crown projected area S2 ($cm^2$) | 98 | 98 | 98 | 98 | 98 | 98 | 98 | 98 | 92 |
| Sole projected area S1 ($cm^2$) | 70 | 60 | 54 | 41 | 54 | 62 | 54 | 54 | 54 |
| (S1/S2) × 100 (%) | 71 | 61 | 55 | 42 | 55 | 63 | 55 | 55 | 59 |
| Curvature radius of sole R1 (cm) | 11 | 11 | 11 | 11 | 11 | 11 | 11 | 13 | 11 |
| ZT-ZC (mm) | 13 | 13 | 13 | 13 | 13 | 13 | 13 | 6 | 11 |
| ZH-ZC (mm) | 13 | 13 | 13 | 13 | 13 | 13 | 13 | 6 | 11 |
| Surface Area S3 of recessed part ($cm^2$) | — | — | 16 | 60 | 40 | 27 | 34 | 40 | 13 |
| Maximum Height Hm (mm) of Recessed Part | — | — | 5 | 25 | 25 | 25 | 25 | 25 | 15 |
| Maximum Angle θm (deg) of Recessed Part | — | — | 80 | 80 | 80 | 80 | 40 | 80 | 64 |
| Head maximum Width W1 (mm) | 113 | 113 | 113 | 113 | 113 | 113 | 113 | 113 | 105 |
| Length W2 (mm) | — | — | 42 | 42 | 42 | 42 | 42 | 42 | 28 |
| W2/W1 | — | — | 0.37 | 0.37 | 0.37 | 0.37 | 0.37 | 0.37 | 0.27 |
| Lateral Moment of Inertia ($g \cdot cm^2$) | 4000 | 3900 | 4100 | 4050 | 4180 | 4230 | 4090 | 4270 | 4090 |
| Peak Frequency (Hz) | 3800 | 4000 | 4100 | 5050 | 5000 | 4800 | 4450 | 4250 | 4950 |
| Sensuous Evaluation | 2.2 | 3.2 | 3.5 | 4.7 | 4.6 | 4.4 | 4.0 | 3.8 | 4.5 |

As shown in Table 1, Examples were more highly evaluated in comparison with Comparative Examples. Accordingly, advantages of the present invention are clearly indicated by these results of evaluation.

The present invention can be applied to every golf club head such as wood golf club heads, utility golf club heads, iron golf club heads, and the like.

The description hereinabove is merely for an illustrative example, and various modifications can be made in the scope not to depart from the principles of the present invention.

What is claimed is:

1. A hollow golf club head comprising a face member, a crown member, a sole member and a recessed part, wherein the recessed part is provided around the sole member at a back side of the club head opposite from the face member such that the periphery of the sole member bordering the recessed part extends in a convex shape away from the face member, the recessed part has a maximum height Hm of equal to or greater than 10 mm, a projected area S1 of the sole member projected on a reference plane accounts for 40% or more and 65% or less of a projected area S2 of the crown member projected on the reference plane;

the head volume is 400 cc or more and 500 cc or less; and wherein a maximum angle θm formed between a margin of the recessed part and an edge of the sole in proximity thereto is equal to or greater than 45 degrees and equal to or less than 120 degrees.

2. The golf club head according to claim 1, wherein a maximum angle θm formed between a margin of the recessed part and an edge of the sole in proximity thereto is equal to or greater than 55 degrees and equal to or less than 90 degrees.

3. The golf club head according to claim 1, wherein a maximum angle θm formed between a margin of the recessed part and an edge of the sole member in proximity thereto is equal to is equal to or greater than 50 degrees.

4. The golf club head according to claim 1, wherein a maximum angle θm formed between a margin of the recessed part and an edge of the sole member in proximity thereto is equal to or greater than 55 degrees.

5. The golf club head according to claim 1, wherein a maximum angle θm formed between a margin of the recessed part and an edge of the sole member in proximity thereto is equal to or greater than 65 degrees.

6. The golf club head according to claim 1, wherein a maximum depth dm of the recessed part is equal to or greater than 3 mm and equal to or less than 20 mm.

7. A hollow golf club head comprising a face member, a crown member, a sole member and a single recessed part, wherein the head has a front side, a back side, a toe side and a heel side, the recessed part is provided around the sole member at a back side of the club head opposite from the face member such that the periphery of the sole member bordering the recessed part extends in a convex shape away from the face member, the recessed part has a maximum height Hm of equal to or greater than 10 mm, a projected area S1 of the sole member projected on a reference plane accounts for 40% or more and 65% or less of a projected area S2 of the crown member projected on the reference plane.

8. The golf club head according to claim 7, wherein a maximum angle θm formed between a margin of the recessed part and an edge of the sole member in proximity thereto is equal to or greater than 45 degrees.

9. The golf club head according to claim 7, wherein a curvature radius of a face of the sole in a toe-heel direction is 9.0 cm or greater and 11.5 cm or less.

10. The golf club head according to claim 7, wherein the maximum height Hm is equal to or greater than 15 mm.

11. The golf club head according to claim 7, wherein a maximum angle θm formed between a margin of the recessed part and an edge of the sole member in proximity thereto is equal to or greater than 50 degrees.

12. The golf club head according to claim 7, wherein a maximum angle θm formed between a margin of the recessed part and an edge of the sole member in proximity thereto is equal to or greater than 55 degrees.

13. The golf club head according to claim 12, wherein a maximum angle θm formed between a margin of the recessed part and an edge of the sole in proximity thereto is equal to or greater than 55 degrees and equal to or less than 90 degrees.

14. The golf club head according to claim 7, wherein a maximum angle θm formed between a margin of the recessed part and an edge of the sole member in proximity thereto is equal to or greater than 65 degrees.

15. The golf club head according to claim 7, wherein a maximum depth dm of the recessed part is equal to or greater than 3 mm and equal to or less than 20 mm.

16. The golf club head according to claim 7, further comprising a side member, wherein the thickness of the side member is equal to or greater than 0.3 mm and equal to or less than 1.2 mm, and the thickness of the sole member is equal to or greater than 0.8 mm and equal to or less than 3.0 mm.

17. The golf club head according to claim 7, further comprising a side member, wherein the thickness of the side member is smaller than the thickness of the sole member.

* * * * *